US005236580A

United States Patent [19]

Kelleher

[11] Patent Number: 5,236,580

[45] Date of Patent: Aug. 17, 1993

[54] DEVICE FOR RECLAIMING DRY CLEANING SOLVENT FROM A DRY CLEANING MACHINE

[75] Inventor: John H. Kelleher, Long Beach, Calif.

[73] Assignee: Kelleher Equipment Co., Inc., Long Beach, Calif.

[21] Appl. No.: 871,953

[22] Filed: Apr. 21, 1992

Related U.S. Application Data

[63] Continuation of Ser. No. 726,751, Jul. 8, 1991.

[51] Int. Cl.[5] ..... D06F 43/08; B01D 53/00

[52] U.S. Cl. ..... 210/97; 34/48; 34/55; 34/80; 34/133 L; 68/18 F; 202/181; 202/200; 202/233; 210/104; 210/117; 210/149; 210/180; 210/191; 210/188; 210/261; 210/263; 210/295

[58] Field of Search ..... 210/86, 97, 104, 117, 210/136, 149, 167, 180, 181, 182, 183, 184, 188, 128, 247.1, 261, 263, 288, 295; 68/18 R, 18 C, 18 F; 34/48, 76, 55, 76, 80, 79, 133 L, 82, DIG. 1; 202/177, 181, 200, 233; 55/387, 420

[56] References Cited

U.S. PATENT DOCUMENTS

| | | | |
|---|---|---|---|
| 2,140,623 | 12/1938 | Hetzer | 202/181 |
| 3,203,110 | 8/1965 | Führing et al. | 34/76 |
| 3,665,734 | 5/1972 | Hauser et al. | 68/18 C |
| 3,674,650 | 7/1972 | Fine | 210/167 |
| 3,696,003 | 10/1972 | Fitch et al. | 202/181 |
| 3,977,218 | 8/1976 | Zucchini | 210/167 |
| 4,091,643 | 5/1978 | Zucchini | 68/18 C |
| 4,217,115 | 8/1980 | Palmer | 55/95 |
| 4,331,514 | 5/1982 | Bauer | 202/181 |
| 4,354,364 | 10/1982 | Holder et al. | 68/18 R |
| 4,415,075 | 11/1983 | McNesky et al. | 202/181 |
| 4,437,937 | 3/1984 | McGraw | 202/181 |
| 4,443,344 | 4/1984 | Lewis | 210/774 |
| 4,581,133 | 4/1986 | Tomes | 68/18 C |
| 4,664,754 | 5/1987 | Caputi et al. | 210/182 |
| 4,769,921 | 9/1988 | Kabakov et al. | 34/27 |
| 4,774,821 | 10/1988 | Luppi et al. | 68/18 C |
| 4,780,218 | 10/1988 | Kohler | 210/774 |
| 4,788,776 | 12/1988 | Fuhring et al. | 68/18 C |
| 4,793,938 | 12/1988 | Dayton | 210/774 |
| 4,879,888 | 11/1989 | Suissa | 68/18 C |
| 4,885,099 | 12/1989 | Kelly | 210/774 |
| 4,917,807 | 4/1990 | Prisco, Jr. et al. | 210/774 |
| 5,068,030 | 11/1991 | Chen | 210/181 |
| 5,107,605 | 4/1992 | Yamada et al. | 34/79 |

FOREIGN PATENT DOCUMENTS

| | | |
|---|---|---|
| 1-17697 | 1/1989 | Japan . |
| 1351302 | 4/1974 | United Kingdom . |

*Primary Examiner*—Robert A. Dawson
*Assistant Examiner*—Sun Uk Kim
*Attorney, Agent, or Firm*—Pretty, Schroeder, Brueggemann & Clark

[57] ABSTRACT

A device and a related method are provided for reclaiming or recovering dry cleaning solvent from otherwise disposable fluid contained within a separator or other suitable receptacle of a dry cleaning machine. The device includes an evaporator and a fluid transfer mechanism for transporting fluid evaporated by the evaporator through a filter that removes substantially all of the solvent present within the evaporated fluid. Alternatively, a filter can be interposed between the separator or other suitable receptacle and the evaporator so that solvent is filtered before reaching the evaporator. Consequently, the device substantially reclaims or recovers dry cleaning solvent that may still be present within the fluid that is to be otherwise disposed of from the separator or other suitable receptacle.

31 Claims, 5 Drawing Sheets

DEVICE FOR RECLAIMING DRY CLEANING SOLVENT FROM A DRY CLEANING MACHINE

This is a division, of application Ser. No. 07/726,751, filed Jul. 8, 1991.

BACKGROUND OF THE INVENTION

This invention relates generally to dry cleaning machines and dry cleaning processes and, more particularly, to devices and related methods which reclaim dry cleaning solvent from dry cleaning machines.

Dry cleaning machines typically cleanse clothing with a dry cleaning fluid which normally includes water and a solvent, such as perchlorethylene ("perc.") or trichlorethylene. Since dry cleaning solvents tend to be toxic to the environment and pose waste disposal problems, dry cleaning machines normally employ a process which substantially recirculates the dry cleaning fluid. Commonly, the fluid is substantially vaporized during the dry cleaning process and recycled in an effort to recover a substantial amount of the solvent that would otherwise be released into the environment. At the end of such dry cleaning processes, the dry cleaning fluid in its vaporous state is condensed back into a liquid and flows through a fluid separator. The separator then separates the water present in the fluid from the solvent and the now separated water is characteristically disposed of in a drainage system or by other suitable means. These processes may also employ filtration devices which filter out solvent from the vapor that is otherwise exhausted from a given dry cleaning machine into the environment. A dry cleaning machine that employs a separator is described in U.S. Pat. No. 3,977,218 to Guido Zucchini and is incorporated by this reference. Certain dry cleaning machines also have central vacuum systems which remove waste water from the dry cleaning machine and transfer it to a suitable receptacle for disposal. Thus, existing dry cleaning machines tend to reduce the amount of solvent that is freely discharged into the environment.

More recently, however, governmental environmental protection agencies and others have begun to focus on the waste water or other waste fluid which is discharged from separators and other appropriate receptacles and into the environment. In this regard, it has been discovered that, despite the use of separators and the like, the waste water still often contains a residual concentration of solvent that is unacceptably high. Certain environmental laws or regulations promulgated, for example, now require that the concentration of residual solvent in the water so discharged cannot exceed four or five parts per billion (ppb.) Consequently, a number of dry cleaning establishments now face a significant waste disposal problem, since they cannot dispose of the water from separators in existing drainage systems without violating these recent environmental laws or regulations. Additionally, a number of businesses which specialize in the transportation and disposal of hazardous waste will not collect the contaminated water from separators in dry cleaning machines. Alternatively, even if waste disposal businesses do dispose of the water, dry cleaning businesses must absorb the added expense of such disposal.

It should, therefore, be appreciated that there exists a definite need for a device and method for reclaiming residual dry cleaning solvent from the waste water that is to be emptied from a fluid separator or other suitable receptacle of a dry cleaning machine and which reclaims the solvent in a manner which is cost effective, environmentally sound, and addresses recently promulgated environmental laws and regulations.

SUMMARY OF THE INVENTION

The present invention, which addresses this need, is embodied in a device and related method for reclaiming dry cleaning solvent from the fluid contained within a separator or other suitable receptacle of a dry cleaning machine. In one embodiment of the invention, the device includes an evaporator and a fluid transfer mechanism for transporting substantially evaporated fluid to a filter that removes substantially all of the solvent present within the evaporated fluid. The evaporator has a reservoir and contains a heating assembly for substantially evaporating the fluid received by the reservoir from the separator or other suitable receptacle within the dry cleaning machine. The heating assembly includes a primary heating element for substantially evaporating the fluid present within the reservoir and a fluid sensor for sensing the presence of the fluid within the reservoir and selectively activating the primary heating element. The primary heating element is advantageously, but not necessarily, situated within the reservoir, while the fluid sensor is associated with the reservoir.

Consequently, the device substantially reclaims or recovers dry cleaning solvent that may still be present within the fluid that is to be otherwise disposed of from the separator or other suitable receptacle. It, therefore, tends to substantially avoid the introduction into drainage or sewer systems and the ambient environment of fluid from the separator or other receptacle which is contaminated with dry cleaning solvent. Moreover, since the solvent is now caught within the filter, it can be disposed of or stored by environmentally approved disposal techniques or regenerated and reused.

In more detailed aspects of the invention, the heating assembly includes a power switch which has a pivotable arm that is contactable with a floater. The floater, which includes a shaft and a disk connected to the base of the shaft, is adapted to sit on the bottom of the reservoir when the reservoir is empty of the fluid and to rise upward from the bottom as the fluid fills the reservoir. Additionally, a power supply is connected to both the switch and the primary heating element. The fluid sensor can also have a mechanism, such as a thermal disk overheating protector, which is associated with the primary heating element and which regulates the thermal output of the primary heating element. The filter also includes a bed of granulated carbon.

In other detailed aspects of the invention, the fluid transfer mechanism includes a housing, which is connected to the reservoir and to a conduit that is connected to the filter, and a blower which is contained within the housing. The blower has a plurality of vanes that are located within the conduit and a check valve is attached to the conduit for regulating the release of the substantially evaporated fluid from the reservoir. Additionally, the primary heating element is an electrically powered heating coil and the device further includes an auxiliary heating element for further evaporating the substantially evaporated fluid. The auxiliary heating element is connected to the reservoir and is located between the reservoir and the fluid transfer mechanism.

In accordance with one method of the invention, fluid is withdrawn from the separator or receptacle and deposited in the reservoir. After being withdrawn into the reservoir, the fluid is substantially evaporated by the primary heating element and transported from the reservoir in its vaporous state to the filter. The filter then removes substantially all of the dry cleaning solvent present within the evaporated fluid.

In another embodiment of the invention, the device includes substantially the same evaporator and fluid transfer mechanism However, it is associated with a carbon tower or filter that is part of the dry cleaning machine itself, instead of being directly connected to a separate tower or filter. In still another embodiment of the invention, the device employs substantially the same evaporator and fluid transfer mechanism, but a carbon tower or filter is interconnected between the separator and the evaporator. Consequently, the carbon tower or filter functions to remove substantially all of the solvent present within the fluid before the fluid empties from the separator into the evaporator. The device then functions as previously discussed to evaporate the fluid. In a further embodiment of the invention, the device includes substantially the same evaporator and fluid transfer mechanism. However, a second fluid separator, with or without granulated carbon, is interconnected between the evaporator and the separator associated with the dry cleaning machine. Therefore, the second separator further removes solvent present within the fluid before the fluid empties from the separator into the reservoir of the evaporator. The evaporated fluid then flows from the evaporator through the fluid transfer mechanism and into a suitable waste disposal container.

Other features and advantages of the present invention will become apparent from the following description of the preferred embodiments, taken in conjunction with the accompanying drawings, which illustrate by way of example, the principles of the invention.

DESCRIPTION OF THE PREFERRED EMBODIMENTS

Figure 1:
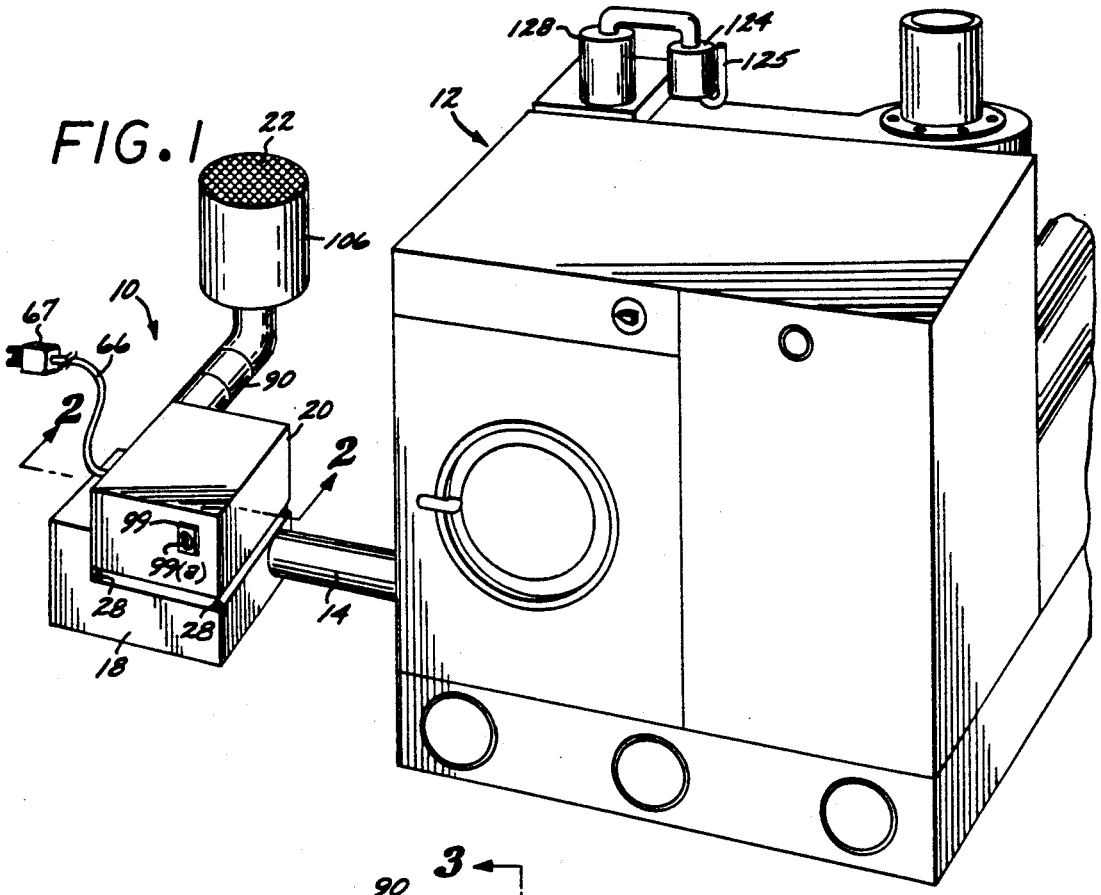
FIG. 1 is a perspective view of a first embodiment of the device connected to a dry cleaning machine.

With reference now to the exemplary drawings, and particularly to FIG. 1, there is shown a device I0 for reclaiming dry cleaning solvent which is connected to a dry cleaning machine 12 by a suitable duct 14. The machine includes a fluid separator 16 of known construction which collects dry cleaning fluid at the end of the dry cleaning process of the machine in a well-understood manner. As is conventional, the dry cleaning fluid includes water and any of a number of solvents, such as perchlorethylene ("perc.") or trichlorethylene. It will be understood that the dry cleaning machine need not specifically employ a fluid separator, but can have any suitable receptacle for collecting fluid that is to be disposed of from the dry cleaning machine.

In accordance with one embodiment of the invention, the device 10 includes an evaporator 18 and a blower assembly 20 for transporting fluid evaporated by the evaporator to a filter 22 that substantially removes any solvent present within the evaporated fluid. (See FIGS. 1-2 and 9). The evaporator has a reservoir 24 and contains a fluid heating assembly 26 for substantially evaporating the fluid received by the reservoir from the separator 16 or other suitable receptacle through the duct 14. Consequently, the device substantially reclaims residual dry cleaning solvent that may still be present within the fluid that is to be emptied from the separator. It, therefore, tends to substantially avoid the introduction into drainage or sewer systems and the ambient environment of fluid from the separator which is contaminated with dry cleaning solvent. Moreover, since the solvent is now caught within the filter, it can be disposed of or stored via environmentally approved waste disposal techniques or regenerated and reused.

Figure 2:
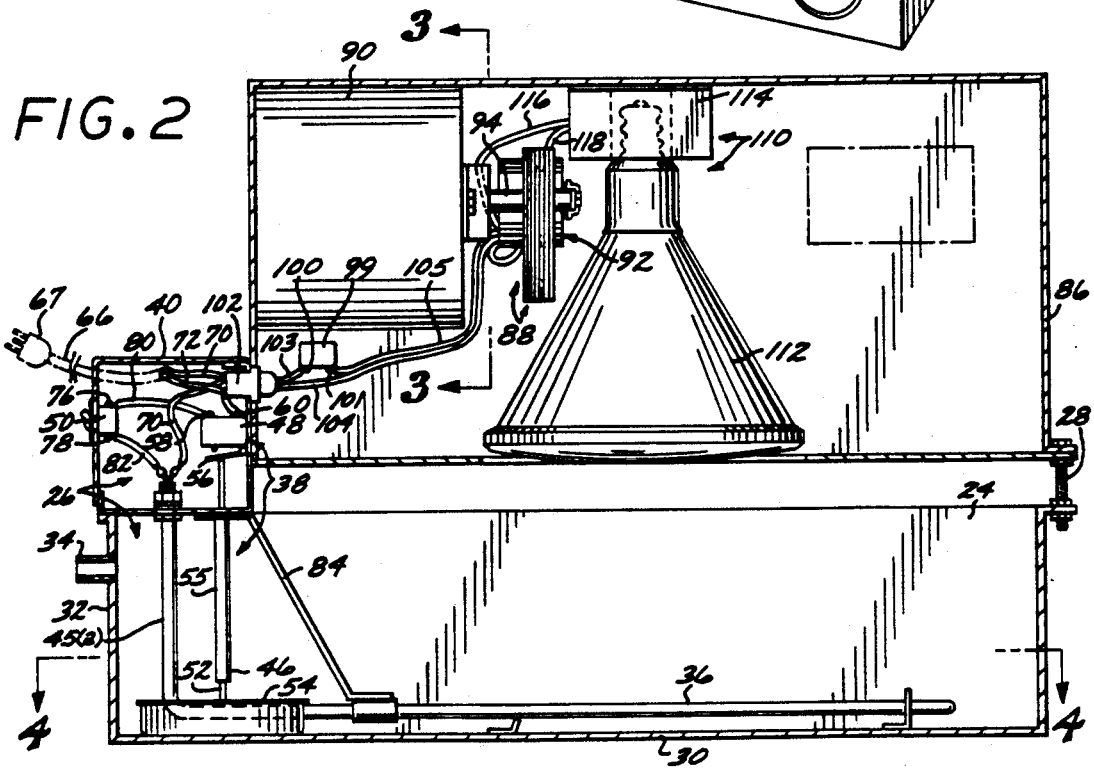
FIG. 2 is a side elevational view of the device, taken substantially along lines 2—2 in FIG. 1.

For the purpose of facilitating maintenance and use of the device 10, the evaporator 18 is connected to the blower assembly 20 by suitable set screws 28. The evaporator and the blower assembly can, however, be made of unitary construction by forming a reservoir 24 out of a housing common to the evaporator and the blower assembly. As depicted in FIGS. 1-2, the reservoir is substantially box shaped, with a substantially planar bottom 30 and sides 32, but without any lid. It is also appropriately dimensioned to accommodate the volume of fluid periodically emptied into it from the separator 16 through the duct 14. Nevertheless, in order to protect against undesirable overflow of the liquid from the reservoir, and to alert its operator to an overflow condition, the reservoir also has a tube 34 which extends axially out of the reservoir near the top of one of the sides 32 of the reservoir. The fluid exiting the tube 34 then can drain into a temporary waste container (not shown).

Figure 4:
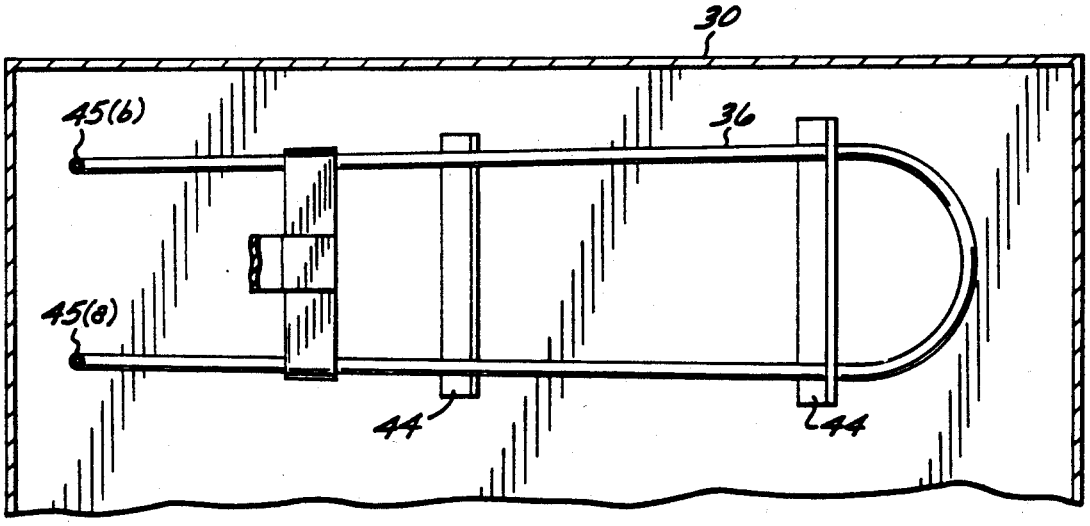
FIG. 4 is another cross-sectional view of the device, taken substantially along lines 4—4 in FIG. 2.

The heating assembly 26 includes a primary heating element 36 and a heating control system 38 which is substantially contained within a protective housing 40 and which senses the presence of fluid collected within the reservoir 24 and selectively activates the primary heating element. (See FIGS. 2, 4 and 5). The housing 40 is secured to the blower assembly 20 by bolts or other suitable means and rests on the top edge of the reservoir 24. It shields the operator from potential electrical shock from contact with the heating control system 38 and protects the system 38 from damage. The primary heating element is advantageously, but not necessarily, an electrically powered heating coil which conducts between nine and fourteen amperes of current at a power output of between 1000and 1500 watts. It is also preferably coated with teflon, which is resistant to damage from exposure to the fluid. As illustrated in FIGS. 1 and 4, the base of the heating element 36 is substantially U-shaped and is attached to the bottom 30 of the reservoir by clamps 44. The two upper sections 45(*a*) and (*b*) of the heating element 36 extend vertically through openings contained within the bottom of the housing 40.

The heating control system 38 includes a floater 46, a heating power switch 48 which activates the primary heating element 36 in response to contact with the floater, and a thermal disk overheating protector 50 that selectively limits the thermal output of the heating element 36. (See FIGS. 2 and 5). More particularly, as shown in FIG. 2, the floater includes a shaft 52 which is capped at its base by a disk 54 and extends vertically within the reservoir 24 so that the disk of the floater sits on the bottom 30 of the reservoir when the reservoir is empty of the fluid. The floater is also made of a suitably buoyant material, such as aluminum or stainless steel, so that it rises upward from the bottom 30 of the reservoir as the reservoir fills with the fluid. In order to stabilize the movement of the floater 46, the shaft 52 extends through a bore within the bottom 30 of the housing 40 and telescopes within a stationary outer shaft 55 which is connected to the housing 40.

Figure 5:
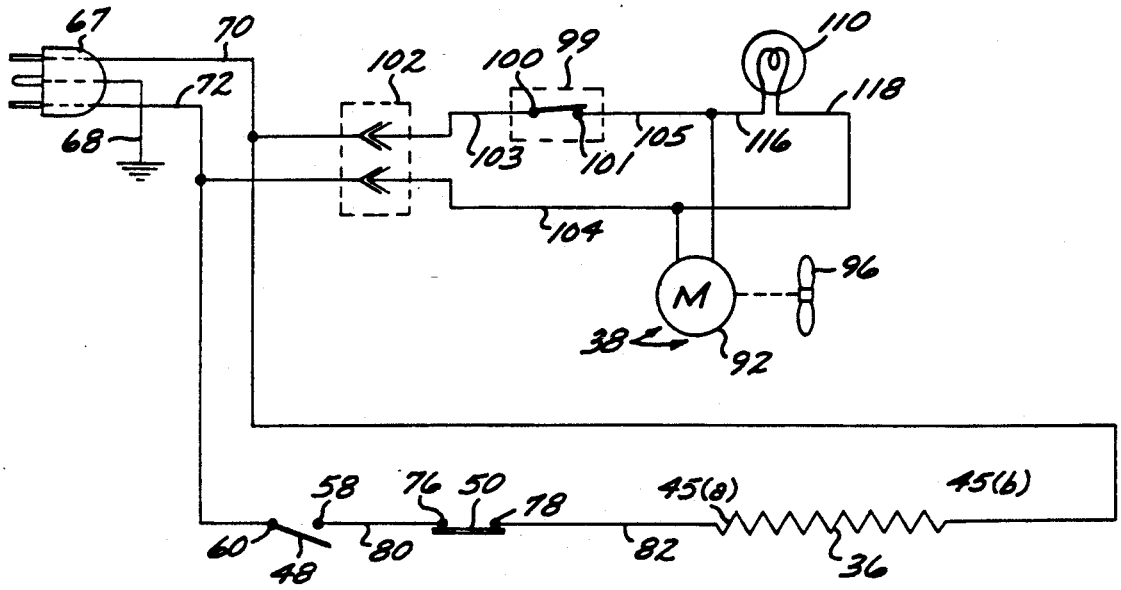
FIG. 5 is a schematic circuit diagram of the heating control system, blower assembly and auxiliary heating element of the first embodiment of the device.

The power switch 48 is attached to the housing 40 and includes a pivotable arm 56, which triggers the switch 48, and terminals 58 and 60 for receiving current supplied by a power cable 66 having an electrical plug 67. (See FIGS. 2 and 5). The switch 48 is any suitable microswitch, such as microswitch model No. A-20GV-B7-K made by Fisher Mfg. of Gardena, California, which preferably, but not necessarily, conducts about 20 amperes of alternating current at between 125 and 220 volts. The arm 56 of the switch 48 abuts the free end of the shaft 52 of the floater 46 such that when the floater rises the arm pivots upward. As shown schematically in FIG. 5, the power cable 66 also contains a ground wire 68 and a pair of electrical current wires 70 and 72, and is connected to a suitable electrical power supply (not shown). As depicted in FIG. 5, the current wire 70 is connected to an electrically conductive terminal associated with the end of a terminal upper section 45(*b*) of the primary heating element 36. On the other hand, the current wire 72 is connected to the terminal 60 of the heating power switch 48. The free end of the ground wire 68 is preferably secured to the housing 40.

The protector 50 is secured to the housing 40 and contains two electrically conductive terminals 76 and 78. An electrical wire 80 extends from the terminal 58 of the power switch 48 to a terminal 76 situated on the protector 50, while a wire 82 leads from the other terminal 78 located on the protector to the remaining upper section 45(*a*) of the primary heating element 36. (See FIGS. 2 and 4). The protector acts somewhat like a thermostat and serves to limit the thermal output of the primary heating element by providing increased resistance to the flow of electrical current through the primary heating element as the temperature of the primary heating element increases. Thus, the thermal output of the primary heating element substantially reaches a steady state limit, because the protector 50 has decreased the conduction of electrical current by the primary heating element. The protector preferably substantially reduces the current through the primary heating element 36 when the primary heating element reaches a temperature of 210° C. A suitable protector for this purpose is sold by Elmwood, Inc. of California under model No. 157-33-L220-90/M.

For the purpose of sensing the thermal output of the primary heating element 36, the protector 50 is associated with a thermally conductive member 84 that extends within the reservoir 24 and is connected to the base of the primary heating element (See FIGS. 2 and 4). The member can be made of any suitable thermally conductive material, such as aluminum or stainless steel.

Figure 3:
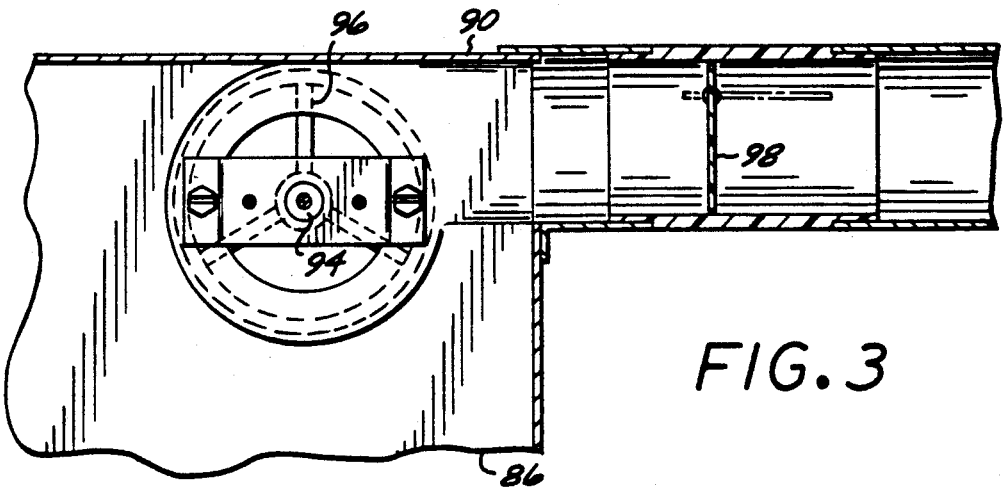
FIG. 3 is a cross-sectional view of a portion of the device, taken substantially along lines 3—3 in FIG. 4.
Figure 6:
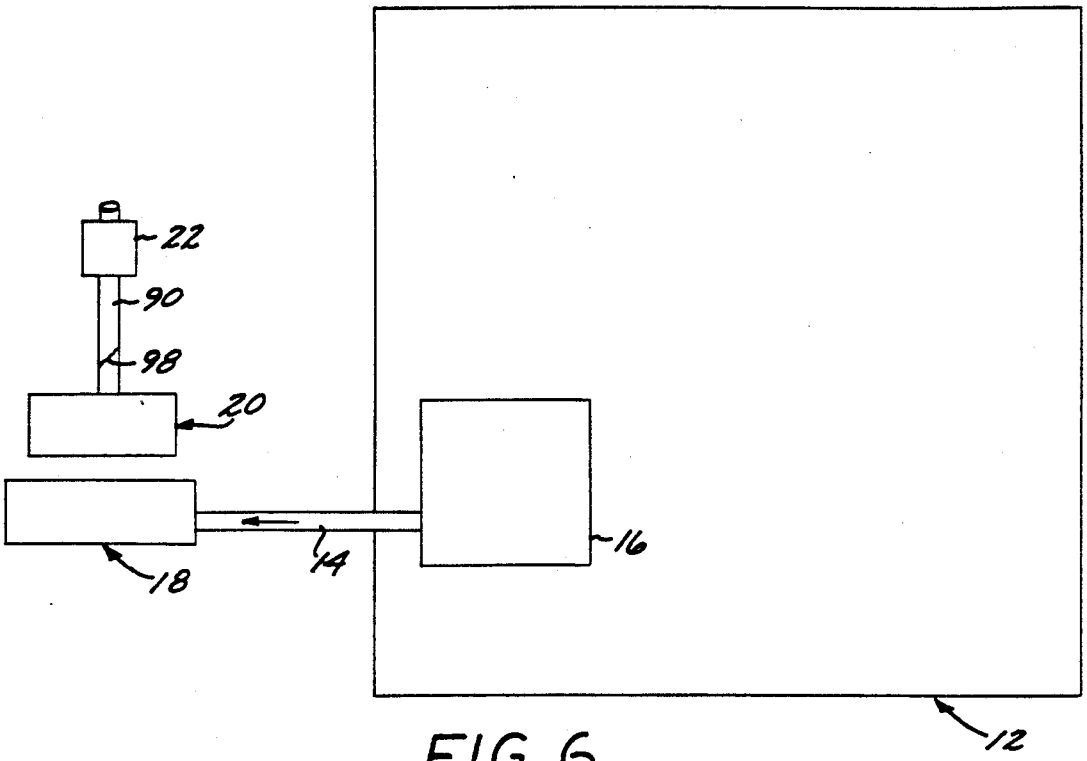
FIG. 6 is a simplified schematic diagram of a first embodiment of the invention associated with a dry cleaning machine.

The blower assembly 20 includes a substantially boxed-shaped housing 86 which contains a blower 88 and has a conduit 90 attached to the exterior of the housing 86. The housing 86 is suitably dimensioned so that it substantially covers the top of the reservoir 24. The blower has an electric motor 92 which drives a shaft 94 upon which a plurality of vanes 96 are mounted. (See FIGS. 2–3 and 5). The motor advantageously, but not necessarily, conducts between 0.8 and 2.5 amperes of current and has a power output of about one-fifteenth of a horsepower. The vanes are situated within a portion of the conduit 90. (See FIG. 4). A check valve 98 can also be pivotably attached within the conduit from which the evaporated fluid exits. In the case of a conduit of circular cross-section, the check valve is substantially disk shaped and pivots open when a stream of evaporated fluid flows through the conduit 90. Conversely, when the blower is deactivated the check valve closes so that the evaporated fluid cannot flow back through the device (See, e.g., FIGS. 3 and 6).

As shown in FIG. 2 and schematically in FIG. 5, the blower assembly 20 also has a blower switch 99 that is activated by a switch lever or button 99(*a*) that is located on the exterior of the blower assembly. The blower switch 99 includes two terminals 100 and 101 and is interconnected to an electrical connector or plug 102 through electrical wires 103. The terminal 100 of the connector 102 is connected to the power cable 66 through the wires 70 and 72. An electrical wire 104 then interconnects the connector 102 to the motor 92 of the blower 88 and another electrical wire 105 interconnects the terminal 101 of the blower switch 99 to the motor 92.

The filter 22, which is of commonly known construction, is connected to the conduit 90 and functions to substantially remove any residual solvent present within the evaporated fluid. The filter advantageously contains a bed of granulated carbon which is encased within a cylindrical housing 106. The bed of carbon absorbs the solvent, but allows the water vapor to pass through the filter and into the ambient environment. It will be appreciated that any of a number of filters or carbon towers commonly used in the dry cleaning industry will suffice. Alternatively, the filter can be a housing containing one or more membranes of carbon or other suitable material which separates the solvent from the water vapor.

For the purpose of facilitating the absorption of the solvent by the filter 22, the device 10 can also include an auxiliary heating element 110. The auxiliary element includes a light bulb 112 that is contained within a socket 114 which is secured to the top of the housing 86 (see FIG. 2). A set of wires 116 and 118 extend from the socket 114 with the wire 116 being associated with the wire 105 and the wire 118 being associated with the wire 104. As such (see FIG. 5), the auxiliary heating element 110, like the blower 88, is triggered by the blower switch 99 and receives electrical power via power cable 66. The bulb is preferably, but not necessarily, an infrared 125 volt bulb which conducts between 1.5 and 2.0 amperes of current and has a power output of between 175 and 250 watts. (See FIGS. 2 and 5). The bulb further is centrally disposed, and extends vertically downward, within the housing 86 so that it is suspended just above the top of the reservoir 24. When activated, the bulb functions to further vaporize the fluid which has been substantially evaporated by the primary heating element 36 before the evaporated fluid is entrained by the blower 88. It will be appreciated that the bulb 112, therefore, facilitates removal of the solvent by the filter.

The operation of the embodiment of the present invention shown in FIGS. 2–6 will now be described. Preliminarily, the operator activates the supply of electrical power to the device 10 via triggering the blower switch 99 through depressing the switch lever 99(*a*). Consequently, the blower 88 and auxiliary heating element 110 are activated. Dry cleaning fluid flows from the separator 16 and into the reservoir 24 through duct 14. As the reservoir begins to fill with the fluid, the floater 46 rises from the bottom 30 of the reservoir and urges the pivotable arm 56 of the power switch 48 upward, thereby triggering the power switch 48. Consequently, electrical current is supplied to the primary heating element 36.

As the primary heating element 36 evaporates the fluid, evaporated fluid rises from the reservoir 24 and is entrained by the blower 88. The evaporated fluid then proceeds through the conduit 90 and through the filter 22 which removes substantially all of the dry cleaning solvent present within the fluid before the fluid is exhausted into the ambient environment from the filter 22. At the same time, the thermal disk overheating protector 50 limits the thermal output of the primary heating element 36 so that the primary heating element will tend not to exceed a predetermined temperature. When the supply of fluid within the reservoir is exhausted, the floater 46 returns to its initial position, thereby releasing the arm 56 of the switch 48 and opening the switch 48. Therefore, the supply of electrical current to the primary heating element ceases. The operator then deactivates the blower 88 and auxiliary heating element 110 by returning the switch to its initial position.

Figure 7:
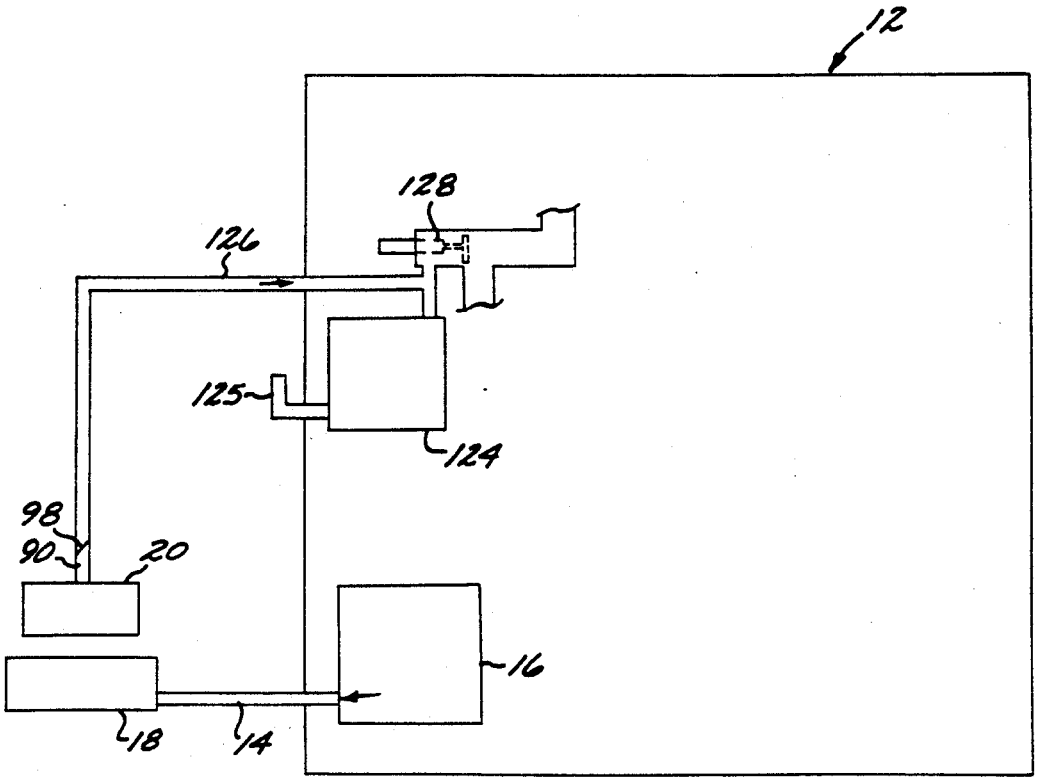
FIG. 7 is a schematic diagram of an alternative embodiment of the invention.

An alternative embodiment of the device 10 is shown in FIG. 7. The device includes the same evaporator 18 and blower assembly 20. However, it is associated with a carbon tower or filter 124 that is part of the dry cleaning machine 12, instead of being directly connected to a separate tower or filter 22 as shown in FIG. 1. In particular, as schematically illustrated in FIG. 7, the evaporator 18 is connected to the carbon tower 124 which has an exhaust tube 125 and is located on the dry cleaning machine via a duct 126. It will be understood that dry cleaning machines typically include an exhaust damper 128 which periodically opens and permits air or other vaporous fluid to pass through the carbon tower or filter 124 where it is then exhausted into the environment through the tube 125. The operation of the alternative embodiment of FIG. 7 is substantially the same as that of the embodiment of FIG. 6. In this particular instance it will also be observed that the check valve 98 associated with the blower assembly is particularly useful, since it reduces the possibility of fluid returning to the device through the duct 14.

Figure 8:
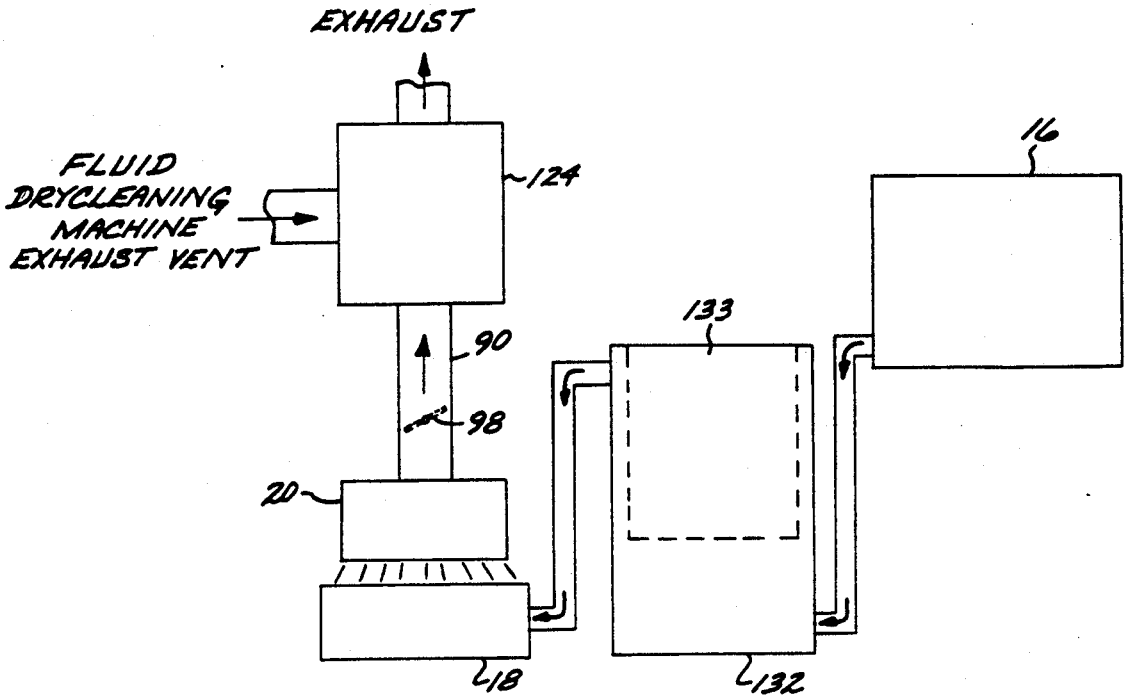
FIG. 8 is a schematic diagram of still another embodiment of the invention.

Still another alternative embodiment of the device 10 is schematically shown in FIG. 8. It has the same evaporator 18 and blower assembly 20 as the device shown in FIGS. 6–7 and utilizes the carbon tower or filter 124 associated with the dry cleaning machine 12. However, in this case a separate carbon tower or filter 132, or even a second fluid separator, is interconnected between the separator 16 and the evaporator 18. On the other hand, in the embodiment shown in FIG. 6, the carbon tower or filter 22 is connected to the conduit 90 of the blower assembly 20. This tower 132 too is of known construction and includes carbon granules 133 for filtering out the solvent. Consequently, the carbon tower 132 functions to remove solvent present within the fluid before the fluid empties from the separator 16 into the evaporator 18. The evaporator and blower assembly then function as previously discussed and the filtered fluid is then exhausted into the environment (see FIG. 8).

Figure 9:
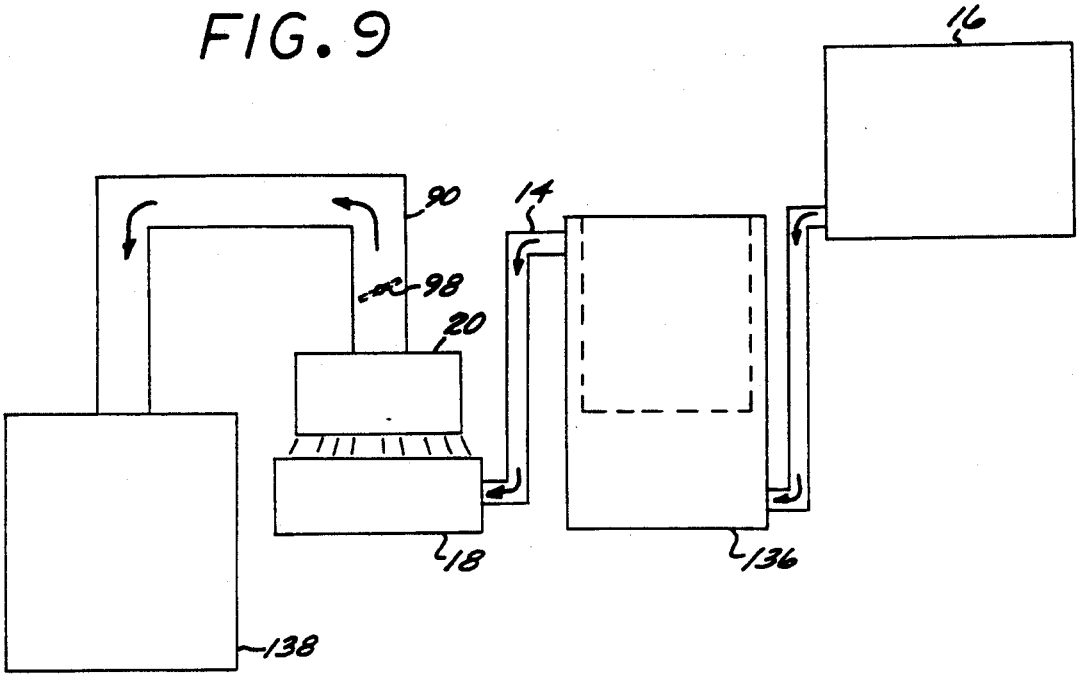
FIG. 9 is a schematic diagram of still another embodiment of the invention.

Still another embodiment of the device 10 is schematically shown in FIG. 9. Here too the evaporator 18 and blower assembly 20 are the same as that shown in FIG. 1. However, a second fluid separator 136, or a second carbon tower or filter, is interconnected between the evaporator 18 and the separator 16. Therefore, the second separator 136 removes solvent present within the fluid before the fluid empties from the separator into the evaporator. The evaporated fluid then flows from the blower assembly into a waste disposal container 138.

Although the invention has been described in detail with reference only to the preferred embodiments, those of ordinary skill in the art will appreciate that various modifications can be made without departing from the invention. Accordingly, the invention is defined only by the following claims.

I claim:

1. For use with a dry cleaning apparatus, a device for reclaiming dry cleaning solvent from a dry cleaning fluid which is contained within a receptacle of the apparatus and is to be disposed of from the receptacle, comprising:

a reservoir for collecting the fluid from the receptacle;

a heating assembly including, (a) a primary heating element for substantially evaporating the fluid, the primary heating element being situated within the reservoir, (b) means for sensing the presence of the fluid within the reservoir and selectively activating the primary heating element, the means being associated with the reservoir;

filter means, associated with the device, for removing substantially all of the dry cleaning solvent present within the fluid as the fluid passes through the filter means; and means for transporting substantially evaporated fluid from the reservoir to the filter means, the means for transporting including a conduit which is connected to the filter means.

2. A device according to claim 1, wherein the receptacle is a separator adapted to separate out the dry-cleaning solvent from the dry cleaning fluid.

3. A device according to claim 1, wherein the primary heating element is an electrically powered heating coil.

4. A device according to claim 1, wherein the means for sensing includes:

a power switch having a pivotable arm;

a floater having a shaft and a disk connected to the base of the shaft, the floater being adapted to sit on the bottom of the reservoir when the reservoir is empty of the fluid and to rise upward from the bottom as the fluid fills the reservoir, the floater further being contactable with the arm;

a power supply connected to the switch and to the primary heating element; and wherein, when the floater rises, the arm pivots so as to close the switch and thereupon activate the power supply to the primary heating element.

5. A device according to claim 4, wherein the means for sensing further includes means, responsive to the thermal output of the primary heating element, for regulating the thermal output of the primary heating element.

6. A device according to claim 5, wherein the means for regulating includes:

a thermal disk overheating protector; and a thermally conductive member which interconnects the protector and the primary heating element.

7. A device according to claim 1, wherein the filter means is a filter having a bed of granulated carbon.

8. A device according to claim 1, wherein:

the means for transporting further includes, (a) a housing which is connected to the reservoir and substantially abuts the top of the reservoir, and (b) a blower which is contained within the housing and has a plurality of vanes that are contained within the conduit; and the conduit is connected to the housing.

9. A device according to claim 8, wherein the means for transporting further includes a check valve attached to the conduit for regulating the release of the substantially evaporated fluid from the reservoir.

10. A device according to claim 1, further including an auxiliary heating element for further evaporating the substantially evaporated fluid, the auxiliary element being connected to the reservoir and being located between the reservoir and the means for transporting.

11. A device according to claim 1, wherein the reservoir is connected to the receptacle.

12. For use with a dry cleaning apparatus, a device for reclaiming dry cleaning solvent from a dry cleaning fluid which is contained within a receptacle of the apparatus and is to be disposed of from the receptacle, comprising:

a reservoir, connected to the receptacle, for collecting the fluid from the receptacle;

a heating assembly including, (a) a primary heating element for substantially evaporating the fluid, the primary heating element being situated within the reservoir, (b) means for sensing the presence of the fluid within the reservoir and selectively activating the primary heating element, the means being associated with the reservoir; and filter means, interconnecting the reservoir and the receptacle, for removing substantially all of the dry cleaning solvent present within the fluid before the fluid is collected by the reservoir as the fluid passes through the filter means.

13. A device according to claim 12, wherein the receptacle is a separator adapted to separate out the dry cleaning solvent from the dry cleaning fluid.

14. A device according to claim 12, wherein the primary heating element is an electrically powered heating coil.

15. A device according to claim 12, wherein the means for sensing includes:

a power switch having a pivotable arm;

a floater having a shaft and a disk connected to the base of the shaft, the floater being adapted to sit on the bottom of the reservoir when the reservoir is empty of the fluid and to rise upward from the bottom as the fluid fills the reservoir, the floater further being contactable with the arm;

a power supply connected to the switch and to the primary heating element; and wherein, when the floater rises, the arm pivots so as to close the switch and thereupon activate the power supply to the primary heating element.

16. A device according to claim 15, wherein the means for sensing further includes means, responsive to the thermal output of the primary heating element, for regulating the thermal output of the primary heating-element.

17. A device according to claim 16, wherein the means for regulating includes:

a thermal disk overheating protector; and a thermally conductive member which interconnects the protector and the primary heating element.

18. A device according to claim 12, wherein the filter means is a filter having a bed of granulated carbon.

19. A device according to claim 12, further including means for transporting substantially evaporated fluid from the reservoir, the means for transporting including a conduit which is associated with the reservoir.

20. A device according to claim 19, wherein:

the means for transporting further includes, (a) a housing which is connected to the reservoir and substantially abuts the top of the reservoir, and (b) a blower which is contained within the housing and has a plurality of vanes that are contained within the conduit; and the conduit is connected to the housing.

21. A device according to claim 20, wherein the means for transporting further includes a check valve associated with the conduit for regulating the release of the substantially evaporated fluid from the reservoir.

22. A device according to claim 12, further including an auxiliary heating element for further evaporating the substantially evaporated fluid, the auxiliary element being associated with the reservoir and being located between the reservoir and the means for transporting.

23. For use with a dry cleaning apparatus, a device for reclaiming dry cleaning solvent from a dry cleaning fluid which is contained within a receptacle of the apparatus and is to be disposed of from the receptacle, comprising:

a reservoir for collecting the fluid from the receptacle;

a heating assembly including, (a) a primary heating element for substantially evaporating the fluid, the primary heating element being situated within the reservoir, (b) means for sensing the presence of the fluid within the reservoir and selectively activating the primary heating element, the means being associated with the reservoir and including (i) a power switch having a pivotable arm;

(ii) a floater having a shaft and a disk connected to the base of the shaft, the floater being adapted to sit on the bottom of the reservoir when the reservoir is empty of the fluid and to rise upward from the bottom as the fluid fills the reservoir, the floater further being contactable with the arm;

(iii) a power supply connected to the switch and to the primary heating element, and (iv) wherein, when the floater rises, the arm pivots so as to close the switch and thereupon activate the power supply to the primary heating element;

filter means, associated with the device, for removing substantially all of the dry cleaning solvent present within the fluid as the fluid passes through the filter means; and means for transporting substantially evaporated fluid from the reservoir to the filter means, the means for transporting including a conduit which is connected to the filter means, the means for transporting further including (a) a housing which is connected to the reservoir and substantially abuts the top of the reservoir, and (b) a blower which is contained within the housing and has a plurality of vanes that are contained within the conduit, and (c) the conduit is connected to the housing.

24. A device according to claim 23, wherein the receptacle is a separator adapted to separate out the dry cleaning solvent from the dry cleaning fluid.

25. A device according to claim 23, wherein the reservoir is connected to the receptacle.

26. A device according to claim 23, wherein the primary heating element is an electrically powered heating coil.

27. A device according to claim 23, wherein the means for sensing further includes means, responsive to the thermal output of the primary heating element, for regulating the thermal output of the primary heating element.

28. A device according to claim 27, wherein the means for regulating includes:

a thermal disk overheating protector; and a thermally conductive member which interconnects the protector and the primary heating element.

29. A device according to claim 23, wherein the filter means is a filter having a bed of granulated carbon.

30. A device according to claim 23, wherein the means for transporting further includes a check valve attached to the conduit for regulating the release of the substantially evaporated fluid from the reservoir.

31. A device according to claim 23, further including an auxiliary heating element for further evaporating the substantially evaporated fluid, the auxiliary element being connected to the reservoir and being located between the reservoir and the means for transporting.

* * * * *